US005602612A

United States Patent [19]

Angeli et al.

[11] Patent Number: 5,602,612

[45] Date of Patent: Feb. 11, 1997

[54] DISPLAY PACKAGE FOR CAMERA AND REPLACEABLE CONSUMABLE

[75] Inventors: Gerald J. Angeli, Fairport; Harland J. Hansen, Rochester, both of N.Y.

[73] Assignee: Eastman Kodak Company, Rochester, N.Y.

[21] Appl. No.: 617,232

[22] Filed: Mar. 18, 1996

[51] Int. Cl.[6] ..... G03B 17/02; B65D 85/38

[52] U.S. Cl. ..... 396/535; 206/316.1; 396/661

[58] Field of Search ..... 354/288; 206/316.1, 206/316.2, 739, 78, 223, 257, 461

[56] References Cited

U.S. PATENT DOCUMENTS

| | | | |
|---|---|---|---|
| D. 298,607 | 11/1988 | Didia | D9/415 |
| D. 298,741 | 11/1988 | Didia | D9/415 |
| 2,945,586 | 7/1960 | Mackes | 206/78 |
| 3,278,015 | 10/1966 | Bernstein | 206/47 |
| 3,279,596 | 10/1966 | Hans-August Prym et al. | 206/78 |
| 4,210,246 | 7/1980 | Kuchenbecker | 206/461 |
| 4,235,336 | 11/1980 | Dudas et al. | 206/419 |
| 4,724,964 | 2/1988 | Hernandez | 206/461 |
| 4,739,353 | 4/1988 | Heuer et al. | 354/76 |
| 4,739,883 | 4/1988 | Mohs et al. | 206/470 |
| 4,804,984 | 2/1989 | Heuer et al. | 354/76 |
| 5,074,416 | 12/1991 | Hustad | 206/524.8 |
| 5,143,215 | 9/1992 | Hartley et al. | 206/333 |
| 5,209,354 | 5/1993 | Thornhill et al. | 206/469 |
| 5,293,993 | 3/1994 | Yates, Jr. et al. | 206/365 |
| 5,337,099 | 8/1994 | Tasaka et al. | 354/76 |

FOREIGN PATENT DOCUMENTS

2652569A1 of 0000 France .

*Primary Examiner*—Safet Metjahic
*Assistant Examiner*—Nicholas J. Tuccillo
*Attorney, Agent, or Firm*—Roger A. Fields

[57] ABSTRACT

A display package assembly comprising a main closed portion housing a camera, and another closed portion housing a consumable such as a film cartridge and/or one or more batteries, is characterized in that the main portion housing the camera is permanently sealed to prevent removal of the camera from the main portion without breaking open the main portion, and the other portion housing the consumable has a removable cover to permit the other portion to be opened and re-closed to replace the consumable without breaking open the other portion.

6 Claims, 3 Drawing Sheets

DISPLAY PACKAGE FOR CAMERA AND REPLACEABLE CONSUMABLE

FIELD OF THE INVENTION

The invention relates generally to the field of packaging, and in particular to a display package for a camera and a consumable such as a film cartridge and/or one or more batteries.

BACKGROUND OF THE INVENTION

It is well known for a camera to be housed together with a film cartridge and/or one or more batteries in a display package in the form of a transparent clam shell container. Examples of display packages which are transparent clamshell containers are disclosed in U.S. Pat. No. 4,739,353, issued Apr. 19, 1988, U.S. Pat. No. Des. 298,741, issued Nov. 29, 1988, and U.S. Pat. No. 4,804,984, issued Feb. 14, 1989.

Typically the camera and the consumable, i.e. the film cartridge and/or one or more batteries, are permanently sealed in the display package between transparent front wall and rear wall parts sealed at their peripheries. To obtain the camera and the consumable, one must break open the package.

If, however, the display package is not sold well before the expiration date of the film supply or the battery, the film supply or the battery should be replaced with a fresh one. This requires that the display package be broken open, which prevents it from being reused.

SUMMARY OF THE INVENTION

According to one aspect of the invention, a display package assembly comprising a clamshell container consisting of a front wall part and a rear part which together house a camera and a consumable such as a film cartridge and/or one or more batteries between them, is characterized in that:

the front wall and rear wall parts are permanently secured to each other to prevent removal of the camera from between them without breaking open the clamshell container;

the front wall part has a front opening opposite the consumable to permit removal of the consumable from between the front wall and rear wall parts without breaking open the clamshell container; and a removable cover is connected to the front wall part to be located over the front opening, and can be removed from over the front opening without breaking the front wall part. Thus, if the display package assembly is not sold well before the expiration date of the film supply or the battery, the film supply or the battery can be readily replaced with a fresh one without the clamshell container being broken open.

According to another aspect of the invention, a display package comprising a main closed portion configured to house a camera, and another closed portion configured to house a consumable such as a film cartridge and/or one or more batteries, is characterized in that:

the main portion for housing a camera is permanently sealed to prevent removal of the camera from the main portion without breaking open the main body portion; and the other portion for housing a consumable has a removable cover to permit the other portion to be opened and re-closed to replace the consumable without breaking open the other portion.

DETAILED DESCRIPTION OF THE INVENTION

Figure 1:
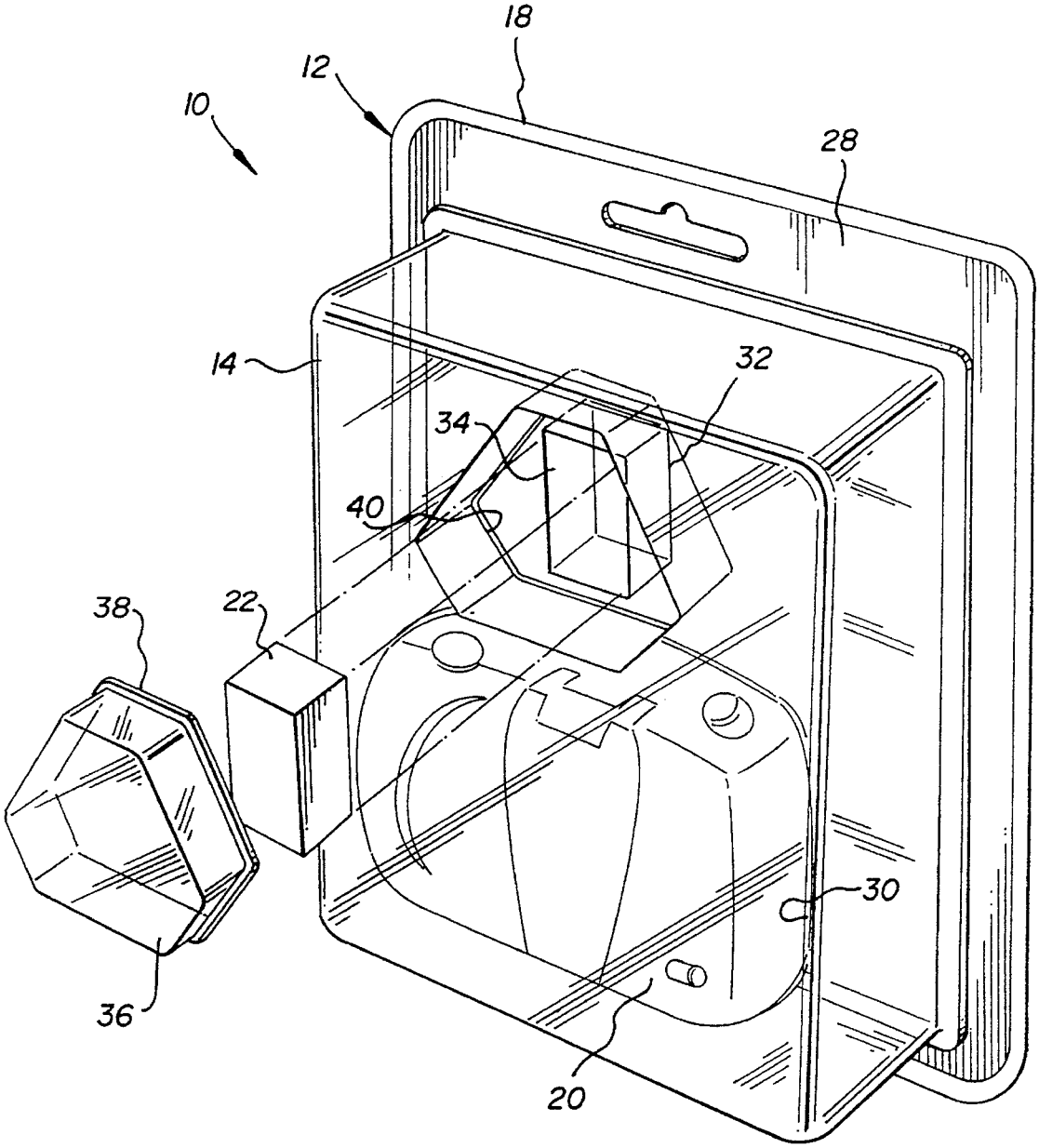
FIG. 1 is an exploded perspective view of a display package for a camera and a replaceable consumable according to a preferred embodiment of the invention.

Referring now to the drawings, FIGS. 1–4 show a display package assembly 10 comprising a transparent plastic flexible clamshell container 12 consisting of a front wall part 14 and a rear wall part 16 secured together along a rectangular periphery 18. The front wall and rear wall parts 14 and 16 house a camera 20 and a consumable 22 such as a film cartridge and/or one or more batteries between them.

Figure 2:
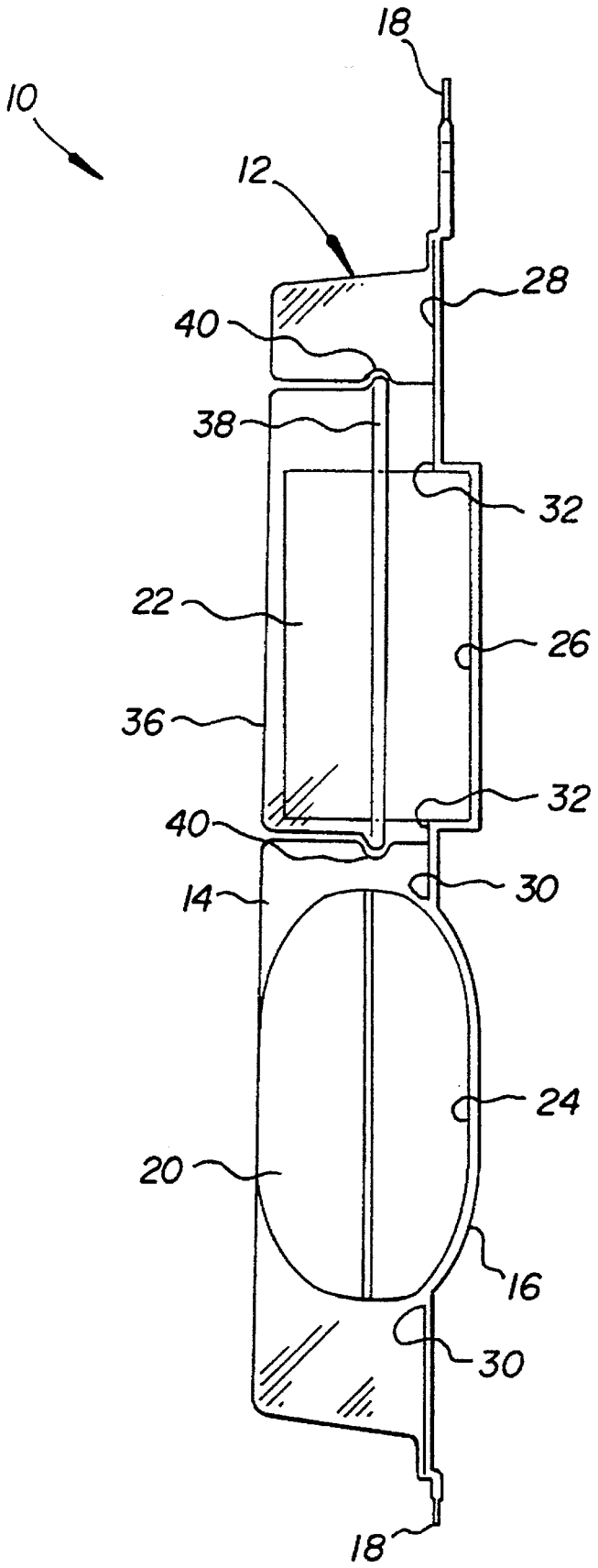
FIG. 2 is a side elevation view of the display package.
Figure 4:
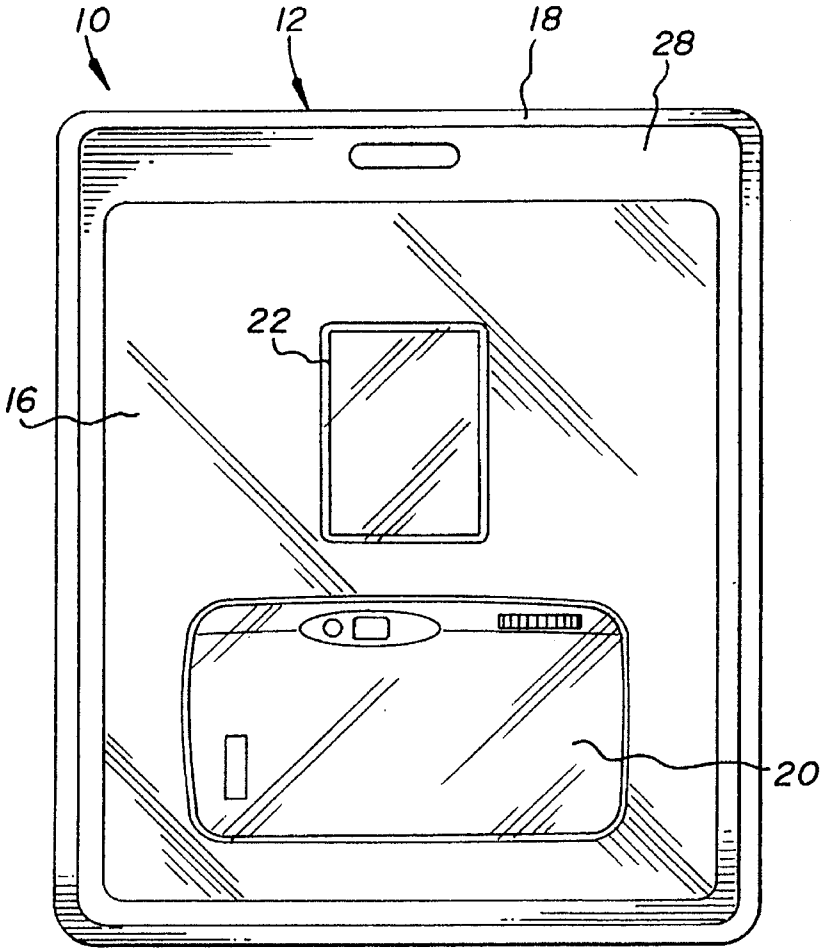
FIG. 4 is a rear elevation view of the display package.
Figure 3:
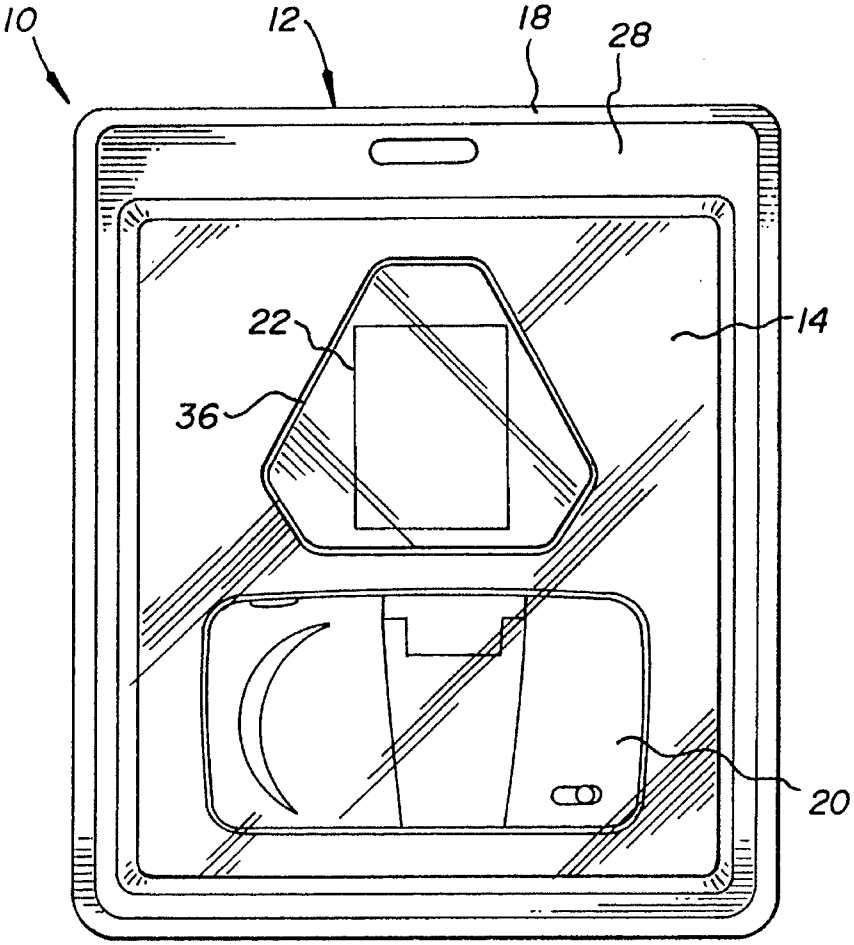
FIG. 3 is a front elevation view of the display package.

The rear wall part 16 is shaped to form respective blown-out rear cavities 24 and 26 which partially hold the camera 20 and the consumable 22 as shown in FIG. 2. A cardboard, flat, rectangular, information-bearing display card 28 is constrained between the front wall and rear wall parts 16 and 18 and has respective holes 30 and 32 surrounding the rear cavities 24 and 26 as shown in FIG. 2.

To remove the camera 20 from the rear cavity 24, one must break open the clamshell container 12 such as by separating the front wall and rear wall parts 14 and 16 along the sealed periphery 18. Conversely, the front wall part 16 has a blown-in front opening 34 which leads to and surrounds the hole 32 in the display card 28 to permit removal of the consumable 22 through the front opening from the rear cavity 26 without having to break open the clamshell container 12. A transparent plastic flexible snap-out front cover 36 has a peripheral tongue 38 that is received in a continuous groove 40 in the front wall part 14, within the front opening 34, to removably engage the front cover to the front wall part over the front opening. See FIGS. 1 and 2. The front cover 36 is temporarily disengaged from the front wall part 14 to permit replacement of the consumable 22.

The invention has been described with reference to a preferred embodiment. However, it will be appreciated that variations and modifications can be effected by a person of ordinary skill in the art without departing from the scope of the invention. For example instead of the front cover 36 being attached to the front wall part 14 via the tongue 36 and the groove 40, the front cover could be pivotally connected to the front wall part.

PARTS LIST

10. display package assembly
12. clamshell container
14. front wall part
16. rear wall part
18. sealed periphery
20. camera
22. consumable
24. rear cavity
26. rear cavity
28. display card
30. card hole
32. card hole
34. front opening
36. front cover
38. tongue
40. groove

We claim:

1. A display package assembly comprising a main closed portion housing a camera, and another closed portion housing a consumable such as a film cartridge and/or one or more batteries, is characterized in that:

said main portion housing said camera is permanently sealed to prevent removal of the camera from the main portion without breaking open the main portion; and said other portion housing said consumable has a removable cover to permit the other portion to be opened and re-closed to replace said consumable without breaking open the other portion.

2. A display package assembly as recited in claim 1, wherein said main portion is permanently sealed along a perimeter, and said other portion including said removable cover is located within said perimeter.

3. A display package comprising a main closed portion configured to house a camera, and another closed portion configured to house a consumable such as a film cartridge and/or one or more batteries, is characterized in that:

said main portion for housing a camera is permanently sealed to prevent removal of the camera from the main portion without breaking open the main body portion; and said other portion for housing a consumable has a removable cover to permit the other portion to be opened and re-closed to replace the consumable without breaking open the other portion.

4. A display package assembly comprising a clamshell container consisting of a front wall part and a rear part which together house a camera and a consumable such as a film cartridge and/or one or more batteries between them, is characterized in that:

said front wall and rear wall parts are permanently secured to each other to prevent removal of said camera from between them without breaking open said clamshell container;

said front wall part has a front opening opposite said consumable to permit removal of the consumable from between said front wall and rear wall parts without breaking open said clamshell container; and a removable cover is connected to said front wall part to be located over said front opening, and can be removed from over said front opening without breaking said front wall part.

5. A display package assembly as recited in claim 4, wherein said rear wall part has respective rear cavities holding said camera and said consumable, and said rear cavity holding said consumable is aligned with said front opening.

6. A display package assembly as recited in claim 5, wherein an information-bearing display card is located between said front wall and rear wall parts and has respective holes located over said rear cavities.

* * * * *